US011466841B2

(12) United States Patent
Seronveaux

(10) Patent No.: US 11,466,841 B2
(45) Date of Patent: Oct. 11, 2022

(54) LUMINAIRE SYSTEM WITH IMPROVED SUPPORT STRUCTURE

(71) Applicant: Schreder S.A., Brussels (BE)

(72) Inventor: Laurent Seronveaux, Bellaire (BE)

(73) Assignee: Schreder S.A., Brussels (BE)

( * ) Notice: Subject to any disclaimer, the term of this patent is extended or adjusted under 35 U.S.C. 154(b) by 0 days.

(21) Appl. No.: 17/417,941

(22) PCT Filed: Dec. 24, 2019

(86) PCT No.: PCT/EP2019/087013

§ 371 (c)(1),
(2) Date: Jun. 24, 2021

(87) PCT Pub. No.: WO2020/136196

PCT Pub. Date: Jul. 2, 2020

(65) Prior Publication Data

US 2022/0074575 A1 Mar. 10, 2022

(30) Foreign Application Priority Data

Dec. 24, 2018 (NL) ..... 2022298

(51) Int. Cl.
*F21V 14/06* (2006.01)
*F21V 5/00* (2018.01)
(Continued)

(52) U.S. Cl.
CPC ..... *F21V 14/06* (2013.01); *F21V 5/007* (2013.01); *F21V 17/02* (2013.01);
(Continued)

(58) Field of Classification Search
CPC ..... F21V 14/06; F21V 5/007; F21V 17/02
See application file for complete search history.

(56) References Cited

U.S. PATENT DOCUMENTS 9,816,672 B1 * 11/2017 Broughton ..... F21V 5/08
2011/0103073 A1 * 5/2011 Jurik ..... F21V 14/06 362/319

(Continued)

FOREIGN PATENT DOCUMENTS

DE 102014217714 A1 3/2016
EP 3557126 A1 10/2019

OTHER PUBLICATIONS

PCT International Search Report and Written Opinion, Application No. PCT/EP2019/087013, dated Mar. 2, 2020, 11 pages.

*Primary Examiner* — Bryon T Gyllstrom
*Assistant Examiner* — Christopher E Dunay
(74) *Attorney, Agent, or Firm* — McDonnell Boehnen Hulbert & Berghoff LLP

(57) ABSTRACT

Example embodiments relate to luminaire systems with improved support structures. One example luminaire system includes a first support having a first surface, a second surface opposite the first surface, and a peripheral edge connecting the first surface to the second surface. The luminaire system also includes a plurality of light sources arranged on the first support. Further, the luminaire system includes a second support movable with respect to the first support and provided with one or more optical elements. Additionally, the luminaire system includes a moving means configured to move the second support relative to the first support, such that a position of the second support with respect to the first support is changed. The first support is provided with at least one cut-out region extending through the first surface and the second surface of the first support. The second support is provided with at least one cut-out region.

20 Claims, 8 Drawing Sheets

(51) Int. Cl.

| | |
|---|---|
| ***F21V 17/02*** | (2006.01) |
| *F21Y 105/16* | (2016.01) |
| *F21Y 115/10* | (2016.01) |
| *F21W 131/103* | (2006.01) |

(52) U.S. Cl.
CPC .... *F21W 2131/103* (2013.01); *F21Y 2105/16* (2016.08); *F21Y 2115/10* (2016.08)

(56) References Cited

U.S. PATENT DOCUMENTS

| | | | | |
|---|---|---|---|---|
| 2014/0098540 | A1* | 4/2014 | Krauss | G02B 19/0019 362/277 |
| 2016/0320029 | A1* | 11/2016 | He | G02B 5/02 |
| 2017/0153004 | A1* | 6/2017 | De Zwart | F21V 14/06 |
| 2020/0263854 | A1* | 8/2020 | Booij | F21V 7/04 |
| 2020/0340644 | A1* | 10/2020 | Lang | F21V 14/02 |
| 2021/0239286 | A1* | 8/2021 | Lang | G02B 26/0875 |
| 2021/0348740 | A1* | 11/2021 | Bory | F21V 5/007 |
| 2021/0381686 | A1* | 12/2021 | Huang | F21V 29/70 |

* cited by examiner

LUMINAIRE SYSTEM WITH IMPROVED SUPPORT STRUCTURE

CROSS-REFERENCE TO RELATED APPLICATIONS

The present application is a national stage entry of PCT/EP2019/087013 filed Dec. 24, 2019, which claims priority to NL 2022298 filed Dec. 24, 2018, the contents of each of which are hereby incorporated by reference.

FIELD OF INVENTION

The present invention relates to the field of luminaire systems, in particular outdoor luminaire systems. Particular embodiments relate to luminaire systems with adjustable photometry.

BACKGROUND

In existing luminaire systems it is common to design a specific printed circuit board (PCB) serving as a support for a plurality of light sources together with a specific optical element plate for each luminaire application, e.g. a pedestrian road, a highway, etc. The design of the PCB and the optical element plate depend notably on the desired light distribution on the surface to be illuminated, i.e. the desired shape of the light onto the illuminated surface. Such approach is costly, time consuming and requires extensive stock keeping.

In prior art solutions, to address the above mentioned problems, optical elements may be provided which are adjustable on an individual basis or within relatively restricted boundaries. Also, it is known to provide a luminaire system in which the position of the optical elements can be adjusted relative to the printed circuit board. However, the existing solutions are still limited in terms of flexibility, especially when it is desirable to be able to build both large and small luminaire systems with a limited amount of different components. Also existing solutions tend to be relatively complex, and an accurate controlling of the movement of the optical elements is difficult to achieve when using the existing solutions.

SUMMARY

The object of embodiments of the invention is to provide a luminaire system integrating an accurate control of the movement of a second support relative to a first support in a compact manner.

According to a first aspect of the invention, there is provided a luminaire system comprising a first support, a plurality of light sources arranged on the first support, a second support, and a moving means. The first support has a first surface, a second surface opposite said first surface, and a peripheral edge connecting the first surface to the second surface. The second support is movable with respect to said first support and provided with one or more optical elements, preferably a plurality of optical elements. The second support has a first surface, a second surface opposite said first surface, and a peripheral edge connecting the first surface to the second surface. The moving means is configured to move the second support relative to the first support, such that a position of the second support with respect to the first support is changed. Optionally, the first support is provided with at least one cut-out region extending through the first surface and the second surface of the first support, and the at least one cut-out region divides the first support in a first part and at least one second part, and is dimensioned and positioned such that said at least one second part can be elastically bent with respect to the first part in a plane of the first support, wherein the at least one second part is coupled to the second support. Alternatively or additionally, the second support is provided with a at least one cut-out region extending through the first surface and the second surface of the second support, and the at least one cut-out region divides said second support in a first part and at least one second part and is dimensioned and positioned such that said at least one second part can be elastically bent with respect to the first part in a plane of the second support, wherein said at least one second part is coupled to the first support.

By providing the first and/or second support with at least one cut-out region as defined above, there is created a structure allowing the second part to be moved in a controlled manner Indeed, the elastic bending of the at least one second part of the first and/or second support will guide and control the movement in an accurate way. Further, this accurate guiding and controlling is made possible via the first and/or second support itself, resulting in a compact luminaire system. The light emitted by the plurality of light sources of the first support will be distributed in a certain manner by the one or more optical elements provided to the second support and associated with the plurality of light sources. Having the plurality of light sources and the one or more optical elements on different supports allow making independent the positioning of one with respect to the other. Indeed, the moving means will allow altering this positioning. By changing the position of the one or more optical elements relative to the plurality of light sources, the light distribution on the surface to be illuminated will be changed as well. In such a way, the light distribution can be controlled in a very accurate manner, and can be adapted more easily to different sites without having to mount different optical components. Changing the light distribution may be done at the factory, during installation as well as during occasional or everyday usage of the luminaire system. By light distribution, it is meant the distribution generated by the light emitted by the plurality of light sources through the one or more optical elements. The light distribution is delimited by a conical envelope, typically a non-circular conical shape, containing the light leaving the one or more optical elements. The light distribution represents the emission directions and the intensity variations of the light within the envelope.

According to an exemplary embodiment, the at least one second part of the first and/or second support comprises a first leg and a second leg. Preferably, the first leg is substantially parallel to the second leg. More preferably, the first and second leg extend parallel to a side of the first and/or second support. Optionally, the at least one second part of the first and/or second support further comprises a connecting part connecting said first leg with said second leg, wherein preferably the connecting part is coupled to the other one of the second and/or first support, respectively. However, in other embodiments the legs of the at least one second part of the first and/or second support may have free unconnected outer ends which may be coupled to the other one of the second and/or first support, respectively. For example, the at least one second part of the first and/or second support may comprise two T- or F-shaped parts with each a free outer end coupled to the second and/or first support, respectively. By providing two legs that may be elastically bent the control of the movement is further improved. Further a connecting part allows for a good coupling between the second support and the first support. Preferably, at least two fixation means are provided at a distance of each other seen in a direction perpendicular on a moving direction.

According to an exemplary embodiment, the plurality of light sources is arranged along a plurality of tracks. When the at least one second part of the first support comprises a first and a second leg, at least one track may be located between the first leg and the second leg. By allowing tracks to be located between the legs, the surface of the first support is efficiently used, further improving the compactness of the system.

According to an exemplary embodiment, the at least one second part of the first and/or second support comprises a substantially π-shaped second part. Optionally, the at least one cut-out region comprises a first cut-out region along an inner edge of said π-shaped second part and a second cut-out region along an outer edge of said π-shaped second part. Alternatively, the π-shaped second part may extend along a portion of the peripheral edge of the first and/or second support, and the at least one cut-out region is a cut-out region along an inner edge of said π-shaped second part According to an exemplary embodiment, the first and/or second support is a polygon, typically a rectangle, having a first side and an adjacent second side, wherein said at least one cut-out region of the first and/or second support extends inwardly from the first side and has a portion which is substantially parallel to a second side of the peripheral edge such that a second part is formed which extends along the second side. Such a cut-out region can be easily cut out from the peripheral side of the first and/or second support.

According to an exemplary embodiment, the second support is provided with at least one through-hole, and at least one fixation means, such as a screw or bolt, extends through said at least one through-hole and couples the second support to the at least one second part of the first support. The at least one through-hole may comprise one or more elongate though-holes extending in a direction of movement.

According to an exemplary embodiment, the at least one second part of the second support is provided with at least one through-hole, and at least one fixation means, such as a screw or bolt, extends through said at least one through-hole and couples the second support to the first part of the first support. The at least one through-hole may comprise one or more elongate though-holes extending in a direction of movement.

According to an exemplary embodiment, the second support comprises a frame and a plurality of optical elements provided to the frame, and the at least one second part of the first support is fixed to the frame. For example, a plurality of lens plates may be arranged in the frame. In this manner, the number of optical elements can be easily adjusted.

According to an exemplary embodiment, the first support is mounted substantially parallel to the second support; and the moving means is configured to move the second support substantially parallel to the first support. In this way, changes in the light distribution can be associated to changes in the profile or in the optical properties, for example changes in the shape, and/or thickness, and/or transparency, of the one or more optical elements in the direction of movement. In the case of the first support being mounted substantially parallel to the second support and moving the same way, lens elements such as non-spherical lenses are preferred.

According to an exemplary embodiment the one or more optical elements comprises one or more lens elements. Indeed, lens elements may be typically encountered in outdoor luminaire systems, although other types of optical elements may be additionally or alternatively present in such luminaires, such as reflectors, backlights, prisms, collimators, diffusors, and the like. According to a preferred embodiment, the second support is arranged such that a lens element of the one or more lens elements extends over a corresponding light source of the plurality of light sources. According to a preferred embodiment, a lens element of the plurality of lens elements has a convex or planar external surface and a concave or planar internal surface facing a light source of the plurality of light sources. In this manner, the light source placed at the internal surface side of the lens element has its emitted light being spread. The shape of the lens element and position of the lens element with respect to the light source will influence the distribution and intensity profile of the emitted light.

Alternatively, the one or more optical elements could be a transparent or translucent cover having a varying profile or varying optical properties (e.g. variation of thickness, transparency, diffusivity, reflectivity, refractivity, colour, etc.) along the movement direction of the second support.

The one or more optical elements may also comprise one or more light shielding structures complying with a certain glare classification, e.g. the G classification defined according to the CIE115:2010 standard and the G* classification defined according to the EN13201-2 standard. The light shielding structures may be configured for reducing a solid angle of light beams of the plurality of light sources by cutting off or reflecting light rays having a large incident angle, thereby reducing the light intensities at large angles and improving the G/G* classification of the luminaire system.

The one or more light shielding structures may be an integral part of a lens plate, or may be provided as one or more separate optical elements. When they are provided as one or more separate optical elements, the one or more light shielding structures may be mounted on a lens plate. In such an embodiment, the one or more shielding structures and the lens plate may be moved together.

According to one embodiment, the light shielding structures may comprise a plurality of closed reflective barrier walls, each having an interior bottom edge disposed on a lens plate, an interior top edge at a height above said interior bottom edge, and a reflective surface connecting the interior bottom edge and the interior top edge and surrounding one or more lenses of said lens plate. The height may be at least 2 mm, preferably at least 3 mm. The interior bottom edge defines a first closed line and the interior top edge defines a second closed line. Preferably, the first closed line and the second closed line comprising at least one curved portion over at least 15%, preferably over at least 20%, more preferably over at least 25%, of a perimeter of said first closed line and a perimeter of said second closed line, respectively. The reflective surface is configured for reducing a solid angle Ω of light beams emitted through the one or more associated lenses of said plurality of lenses. Exemplary embodiments of shielding structures are disclosed in patent application NL2023295 in the name of the applicant which is included herein by reference.

According to another embodiment, the light shielding structures may comprise a plurality of reflective barriers, each comprising a base surface disposed on a lens plate, a top edge at a height above said base surface, and a first reflective sloping surface connecting the base surface and the top edge and facing one or more lenses of the lens plate. The first reflective sloping surface may be configured for reflecting light rays emitted through one or more first lenses of the lens plate having a first incident angle with respect to an axis substantially perpendicular to the base surface between a first predetermined angle and 90°, with a first reflection angle with respect to said axis smaller than 60°. The first predetermined value may be a value below 90°. In other words, when the first incident angle is between the first predetermined value and 90°, the first reflective sloping surface reflects the incident ray such that the reflected ray has a reflection angle with respect to said axis smaller than 60°. According to an embodiment, at least one reflective barrier of the plurality of reflective barriers further comprises a second reflective sloping surface opposite the first reflective sloping surface, configured for reflecting light rays emitted through one or more second lenses adjacent to the one ore more first lenses associated with the first reflective sloping surface, having a second incident angle with respect to an axis substantially perpendicular to the base surface comprised between a second predetermined angle and 90°, with a second reflection angle with respect to said axis smaller than 60°. Exemplary embodiments of shielding structures are disclosed in patent application PCT/EP2019/074894 in the name of the applicant which is included herein by reference.

Further, different light sources may be arranged on the support structure. For example, a first light source may have a first colour temperature and a second light source may have a second colour temperature. Further, different optical elements may be arranged over different light sources. For example, the optical elements may have different shapes, or may comprise a transparent or translucent portion having different optical properties (e.g. differences of thickness, transparency, diffusivity, reflectivity, refractivity, colour, etc.) along the movement direction of the second support.

According to an exemplary embodiment, a lens element of the one or more lens elements has a maximum length different from a maximum width, wherein said length is an internal dimension of the lens element seen in the movement direction of the moving means and said width is an internal dimension of the lens element seen perpendicularly to the movement direction of the moving means. In this way, a lens element has an outer shape lacking symmetry which allows a change in the light distribution when moved.

According to an exemplary embodiment, a lens element of the one or more lens elements has a varying profile or varying optical properties (e.g. variation of thickness, transparency, diffusivity, reflectivity, refractivity, colour, etc.) seen in a movement direction of the moving means. In this way, the change in the light distribution caused by the moving means can be controlled by choosing an appropriate profile or optical properties.

According to a preferred embodiment, the luminaire system further comprises a controlling means configured to control the moving means, such that the movement of the second support with respect to the first support is controlled. In this manner, moving the second support with the moving means is more precise for the positioning of the one or more of optical elements relative to the plurality of light sources. A greater precision of the movement will lead to a greater adaptability of the luminaire system. For example, the controlling means may be configured to control the moving means to position the one or more optical elements in a plurality of positions resulting in a plurality of lighting patterns on a surface.

According to a preferred embodiment, an optical element, e.g. a lens element has an internal dimension D seen in a movement direction of the moving means; and the controlling means is configured to control the moving means such that the second support is moved over a distance below 90% of the internal dimension D of the optical element, preferably below 50% of the internal dimension D. In an embodiment with a lens element, the internal dimension D corresponds to the distance between the boundaries of a cavity facing the corresponding light source as measured in the moving direction.

In this manner, changes in the light distribution are achieved by changes in the profile or optical properties of an optical element along a trajectory of movement. Movements may be limited such that the light emitted by the light sources is distributed in an adequate manner by the corresponding optical elements. The mentioned adequate manner can correspond to a movement whose distance is below 90%, preferably below 50%, of the internal dimension of the optical element such that the light sources can be kept in correspondence with their respective optical elements. Optical elements such as lenses and collimators may possess an internal dimension as defined above. In another embodiment, the luminaire system comprises more optical elements than light sources, and the controlling means is configured to control the moving means such that the second support is moved relative to the first support in a such a way that a given light source is moving from one optical element to another optical element.

According to a preferred embodiment, the luminaire system further comprises a guiding means configured for guiding the movement of the second support with respect to the first support. For example, the guiding means may comprise a first sliding guide and a second sliding guide parallel to the first sliding guide, said first and second sliding guide extending in a direction of movement of the moving means.

According to an exemplary embodiment, the second support is arranged to move in contact with the first support. In this way, the distance between the first support and the second support is zero and fixed, which allows for a better determination of the expected light distribution corresponding to different positions of the second support with respect to the first support. According to another exemplary embodiment, the second support is arranged to move at a fixed distance of the first support, e.g. a PCB. To that end, the first support may be provided with distance elements on which the second support is movably supported. Optionally, a surface of the second support facing the first support, or a surface of the first support facing the second support, may be provided with tracks or guides cooperating with the distance elements. Such tracks or guides may be formed integrally with the rest of the second support, or with the rest of the first support, respectively. Optionally, the distance elements may be adjustable in order to adjust the distance between the first support and the second support. For example, the distance elements may comprise a screw thread cooperating with a bore arranged in/on the first or second support.

According to an exemplary embodiment, the luminaire system further comprises a sensing means. The sensing means may comprises any one or more of a presence sensor, an ambient light sensor, an ambient visibility sensor, a traffic sensor, a dust particle sensor, a sound sensor, an image sensor such as a camera, an astroclock, a temperature sensor, a humidity sensor, a ground condition measurement sensor such as a ground reflectivity sensor, a lighting pattern sensor, a speed detection sensor.

According to a preferred embodiment, the luminaire system further comprises a sensing means configured to acquire a measure for a position of the second support relative to the first support, and the controlling means is configured to control the moving means in function of the acquired measure. In this manner, the sensing means can obtain the position of the second support relative to the first support and a specific desired light distribution corresponding to a specific position of the second support can be achieved by the movement of the second support with respect to the first support controlled by the controlling means.

According to an exemplary embodiment, the luminaire system further comprises an environment sensing means configured to detect environmental data; and the controlling means is configured to control the moving means in function of the detected environmental data. The environment sensing means may be provided in a luminaire head of the luminaire system or to another component of the luminaire system, e.g. to a pole of the luminaire, or in a location near the luminaire. In this way, the environment sensing means can detect environmental data, e.g. luminosity, visibility, weather condition, sound, dynamic object (presence and/or speed), ground condition such as a ground reflectivity property, humidity, temperature, lighting pattern, time of the day, day of the year, of the surroundings of the luminaire system. The environment sensing means may be provided to the luminaire system or may be added in a later phase of the luminaire system installation. Controlling the moving means in function of the detected environmental data may allow changing the light distribution, and thus the lighting pattern of the luminaire system in accordance with the detected environmental data in a more dynamic manner, e.g. compensating luminosity depending on weather or time of the day, changing to a lighting pattern more adapted for a passing cyclist.

According to a preferred embodiment, the luminaire system further comprises a pattern sensing means, e.g. a camera, configured to acquire a measure for a lighting pattern produced by the luminaire system; and the controlling means is configured to control the moving means in function of the acquired measure. The pattern sensing means may be provided to a luminaire head of the luminaire system or to another component of the luminaire system, e.g. to a pole of the luminaire, or in a location near the luminaire. In this manner, the pattern sensing means can acquire a measure of a lighting pattern associated with a corresponding position of the one or more optical elements. Then, controlling the moving means in function of the acquired measure will enable a more adapted lighting pattern to be achieved relative to the current environment of the luminaire system. Further, acquiring a measure of the surface area associated with the lighting pattern will enable the correlation between a position of the one or more optical elements and the resulting lighting pattern. In an embodiment with a feedback loop, the controlling means may correct, e.g. may regularly or continuously correct the position of the one or more optical elements respective to the plurality of light sources based on the data from the pattern sensing means. It is noted that also data from pattern sensing means of nearby luminaire systems may be taken into account when correcting the position. For example, if a luminaire is positioned between two other luminaires, the lighting patterns thereof may partially overlap. Further, the data of the environment sensing means located on one luminaire may be used for controlling several neighbour luminaires. The lighting pattern measured by the central luminaire may also be used to correct the position of the one or more optical elements respective to the plurality of light sources of the other two luminaires.

According to an exemplary embodiment, the first support comprises an array of light sources with at least two rows of light sources and at least two columns of light sources.

According to a preferred embodiment, the luminaire system further comprises a driver configured to drive the plurality of light sources; and optionally a dimmer configured to control the driver to drive one or more of the plurality of light sources at a dimmed intensity. In this manner, the energy supplied to the light sources is controlled by the driver. The optional addition of a dimmer would allow obtaining a greater variety of light distributions by varying the light intensity in addition to the positioning of the light sources respective to the optical elements. Preferably, the plurality of light sources is a plurality of LEDs. Moreover, the dimming level may be different from one light source to another.

According to an exemplary embodiment, the plurality of light sources may comprise a plurality of first light sources having a first colour temperature and a plurality of second light sources having a second colour temperature different from the first colour temperature. One or more first optical elements and one or more second optical elements may be associated with the plurality of first and second light sources, respectively. The plurality of first light sources may be driven according to a first profile, and the plurality of second light sources may be driven according to a second profile, such that either the first plurality of light sources is on (optionally with a first dimming level) or the second plurality of light sources is on (optionally with a certain second level), or such that they are both on (optionally with a first and second dimming level). In that manner not only the light distribution may be changed but also the colour temperature of the emitted light.

According to an exemplary embodiment, the controlling means is configured for controlling the moving means and the driver and optionally the dimmer to control the movement, the intensity, the flashing pattern, the light colour and/or the light colour temperature, respectively. Preferably, the controlling means is configured to set a particular position of the second support relative to the first support in combination with a light intensity, and/or a flashing pattern, and/or a light colour and/or light colour temperature. In the context of the present application "light colour data" can refer to data for controlling a colour (e.g. the amount of red or green or blue) and/or data for controlling a type of white light (e.g. the amount of "cold" white or the amount of "warm" white).

According to an embodiment, the controlling means is further configured for controlling the moving means based on the lighting data received from a remote device. Lighting data may comprise e g dimming data, switching data, pattern data, movement data, light colour data, flashing pattern data, light colour temperature data, etc. For example, the movement data for a particular luminaire may be determined by a remote device based on measurement data measured by one or more luminaires. It is further possible to link the movement data to the light colour data and/or to the dimming data and/or to the light colour temperature data and/or to the flashing pattern data, so that the light colour and/or the light intensity and/or the light colour temperature and/or the flashing pattern is changed during the moving or after the moving.

According to an exemplary embodiment, the moving means comprises a linear actuator, preferably a stepper motor. According to another exemplary embodiment, the moving means comprises a bi-metal. In this way, translational motion of the second support relative to the first support can be carried out.

According to an exemplary embodiment, an optical element of the one or more optical elements, typically a lens element of the one or more lens elements has an internal surface facing a light source of the plurality of light sources and an external surface. The internal surface and/or the external surface may comprise a first curved surface and a second curved surface, said first curved surface being connected to said second curved surface through a connecting surface or line comprising a saddle point or discontinuity. The second support is movably arranged relative to the first support to position the light source either in at least a first position facing the first curved surface or in at least a second position facing the second curved surface. When the external surface is implemented as described, preferably the external surface comprises a first outwardly bulging surface, a second outwardly bulging surface, and an external connecting surface or line connecting said first and second outwardly bulging surfaces. However, it is also possible to have a continuous outer surface and to implement only the internal surface as described. When the internal surface is implemented as described, preferably the internal surface comprises a first outwardly bulging surface, a second outwardly bulging surface, and an internal connecting surface or line connecting said first and second outwardly bulging surfaces. The term "outwardly bulging surface" is used here to refer to a surface which bulges outwardly, away from an associated light source. An outwardly bulging external surface forms a protruding portion, whilst an outwardly bulging internal surface forms a cavity facing an associated light source.

By providing such curved surfaces, the optical element is given a "double bulged" shape allowing to generate distinct lighting patterns depending on the position of the light source with respect to the optical element. More in particular, the shape, the size and the location of the light beam may be different depending on the position of the light source with respect to the optical element. This will allow illuminating various types of roads or paths with the same luminaire system. Also, this will allow adjusting a lighting pattern in function of the height at which the luminaire system is located above the surface to be illuminated.

Preferably, each optical element has a circumferential edge in contact with the first support, and the internal connecting surface or line is at a distance of the first support.

Preferably, the first outwardly bulging surface and the first support delimit a first internal cavity, the second outwardly bulging surface and the first support delimit a second internal cavity, and the internal connecting surface or line and the first support delimit a connecting passage between the first and second internal cavity. Such a connecting passage will allow a light source to pass from the first to the second cavity and vice versa. Preferably, a first maximal width (w1) of the first internal cavity, and a second maximal width (w2) of the second internal cavity are bigger than a third minimal width (w3) of the connecting passage between the first and second internal cavity. The first and second maximal width and the third minimal width extend in the same plane, preferably an upper plane of the first support, in a direction perpendicular on the moving direction. The first and second maximal width may also be different. The widths are measured in a lower plane of the optical element, delimiting the open side of the cavities, and the maximal width corresponds to a maximal width in this plane.

Preferably, the first curved surface is at a first maximal distance of the first support, the second curved surface is at a second maximal distance of the first support, and the saddle point or discontinuity is at a third minimal distance of the first support, said third minimal distance being lower than said first and second maximal distance. More preferably, the first and second maximal distance are different. Those characteristics may apply for the external and/or internal curved surfaces.

In an exemplary embodiment, the luminaire system comprises a luminaire head with a fixation end configured for being attached to a pole, and the first maximal distance defined above is larger than the second maximal distance defined above, and the optical element is arranged such that the first internal and/or external curved surface is closer to the fixation end of the luminaire head than the second internal and/or external curved surface.

In an exemplary embodiment, the optical element further comprises at least one reflective element configured to reflect a portion of the light emitted by the light source, wherein preferably said at least one reflective element comprises a first reflective surface located at a first edge of the first curved surface and a second reflective surface located at a second edge of the first curved surface, wherein the second edge is an edge near the connecting surface or line and the first edge is opposite the second edge, away from the connecting surface or line. Alternatively or additionally, the light source may be provided with a reflective element. Using one or more reflective elements, light may be directed to the street side of the luminaire in a more optimal manner.

In the examples above an optical element comprises two adjacent curved surfaces bulging outwardly, but the skilled person understands that the same principles can be extended to embodiment with three or more adjacent curved surfaces bulging outwardly. Also, it is possible to provide an optical element with an array of bulged surfaces, e.g. an array of n×m bulged surfaces with n>=1 and m>=1.

According to another aspect, there is provided a luminaire network system comprising a plurality of luminaire systems preferably according to any one the embodiments described above, and a remote device. The remote device may be configured to send lighting data to each luminaire system. The controlling means of the or each luminaire system may be configured for controlling the moving means based on the lighting data received by the luminaire system. Lighting data may comprise e g dimming data, switching data, pattern data, movement data, light colour data, flashing pattern data, light colour temperature data, etc. For example, the movement data for a particular luminaire system may be determined by the remote device based on measurement data measured by one or more luminaires. It is further possible to link the movement data to the light colour data and/or to the dimming data and/or to the light colour temperature data and/or to the flashing pattern data, so that the light colour and/or the light intensity and/or the light colour temperature and/or the flashing pattern is changed during the moving or after the moving.

According to an exemplary embodiment, the or each luminaire system is further configured for transmitting measurement data from the pattern sensing means to the remote device. The remote device is further configured to determine lighting data for the or each luminaire head, based on the measurement data.

According to an exemplary embodiment, the or each luminaire system is further configured for transmitting environmental data from the environment sensing means to the remote device. The remote device is further configured to determine lighting data for the or each luminaire head, based on the environmental data. Environmental data may comprise e.g. luminosity data, visibility data, humidity data, temperature data, image data, audio data, presence data, etc.

It is noted that in the context of the application "a moving means" may refer to one or more actuators to move the second support relative to the first support. The moving may be a translation and/or a rotation and, more generally the second support may be moved relative to the first support along any trajectory using any suitable moving means.

In the context of the invention, a lens element may include any transmissive optical element that focuses or disperses light by means of refraction. It may also include any one of the following: a reflective portion, a backlight portion, a prismatic portion, a collimator portion, a diffusor portion.

For example, a lens element may have a lens portion with a concave or convex surface facing a light source, or more generally a lens portion with a flat or curved surface facing the light source, and optionally a collimator portion integrally formed with said lens portion, said collimator portion being configured for collimating light transmitted through said lens portion. Also, a lens element may be provided with a reflective portion or surface or with a diffusive portion.

In the context of this invention, when specifying that the second support is moved with respect to or relative to the first support, it is implied that the second support and/or the first support may be moved, i.e. the first support may be fixed and the second support may be moved, or the second support may be fixed and the first support may be moved, or both the first and the second support may be moved. However, preferably the second support is moved and the first support is fixed.

Preferred embodiments relate to a luminaire system of an outdoor luminaire. By outdoor luminaire, it is meant luminaires which are installed on roads, tunnels, industrial plants, campuses, parks, cycle paths, pedestrian paths or in pedestrian zones, for example, and which can be used notably for the lighting an outdoor area, such as roads and residential areas in the public domain, private parking areas, access roads to private building infrastructures, etc.

BRIEF DESCRIPTION OF THE FIGURES

The accompanying drawings are used to illustrate presently preferred non-limiting exemplary embodiments of systems of the present invention. The above and other advantages of the features and objects of the invention will become more apparent and the invention will be better understood from the following detailed description when read in conjunction with the accompanying drawings, in which.

DETAILED DESCRIPTION OF THE FIGURES

Figure 1:
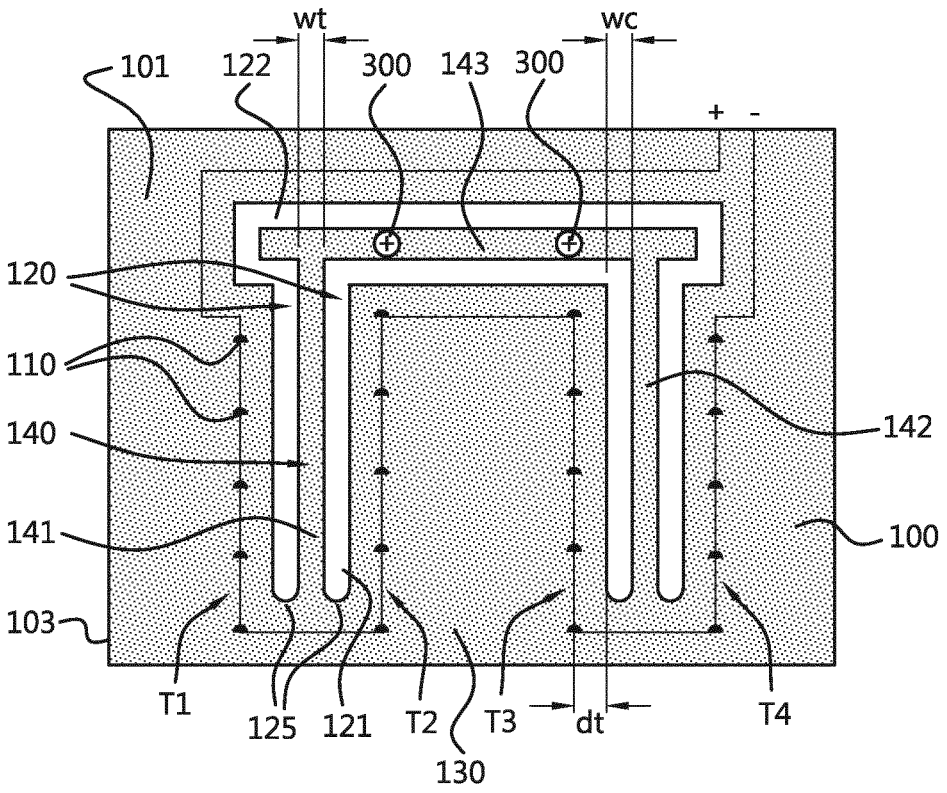
FIG. 1 illustrates a schematic top view of an exemplary embodiment of a first support for use in a luminaire system.

Aspects of the present invention will now be described in more detail, with reference to the appended drawings showing currently preferred embodiments of the invention. Like numbers refer to like features throughout the drawings.

Embodiments of a luminaire system of the invention comprise a first support, a plurality of light sources arranged on the first support, a second support movable with respect to the first support and provided with a plurality of optical elements, and a moving means configured to move the second support relative to the first support. Preferably, the second support is movable in a plane which is substantially parallel to the first support.

The luminaire system typically comprises a luminaire head with a luminaire housing and optionally a luminaire pole. The luminaire head may comprise the first support, e.g. a PCB and second support, e.g. a lens plate. The luminaire head may be connected in any manner known to the skilled person to the luminaire pole. Typical examples of such systems are street lights. In other embodiments, a luminaire head may be connected to a wall or a surface, e.g. for illuminating buildings or tunnels. A luminaire driver may be provided in or on the luminaire head, or in or on a luminaire pole, and more generally anywhere in the luminaire system. The moving means may also be provided in the luminaire head. Also a driver for feeding the moving means may be provided in or on the luminaire head, or in or on a luminaire pole, and more generally anywhere in the luminaire system. The luminaire driver and the driver for the moving means may be the same or distinct.

The first support may comprise a supporting substrate, e.g. a PCB, and a heat sink onto which the supporting substrate may be mounted, said heat sink being made of a thermally conductive material, e.g. aluminium. Alternatively the PCB may be mounted directly on the luminaire housing functioning as heat sink. The plurality of light sources may comprise a plurality of LEDs. Further, each light source may comprise a plurality of LEDs, more particularly a multi-chip of LEDs. The plurality of light sources may be arranged without a determined pattern or in an array with at least two rows of light sources and at least two columns of light sources, typically an array of more than two rows and more than two columns. The surface onto which the plurality of light sources is mounted on can be made reflective or white to improve the light emission. The plurality of light sources could also be light sources other than LEDs, e.g. halogen, incandescent, or fluorescent lamps.

The second support may comprise a plurality of optical elements, typically lens elements, associated with the plurality of light sources. Indeed, lens elements may be typically encountered in outdoor luminaire systems, although other types of optical elements may be additionally or alternatively present in such luminaires, such as reflectors, backlights, collimators, diffusors, and the like. The plurality of optical elements may be mounted such that each of the plurality of light sources is arranged opposite an optical element. In the exemplary embodiment shown in the Figures, the optical elements are lens elements which are similar in size and shape and there is one lens element for each light source. In another exemplary embodiment, some or all of the optical elements may be different from each other. In a further exemplary embodiment, there may be more optical elements than light sources, and the second support may be movable such that a light source can be moved from a position opposite a first optical element to a position opposite a second optical element. In other embodiments, there may be provided a plurality of LEDs opposite some or all of the optical elements. The lens elements may be in a transparent or translucent material. They may be in optical grade silicone, glass, poly(methyl methacrylate) (PMMA), polycarbonate (PC), or polyethylene terephthalate (PET).

Figure 7:
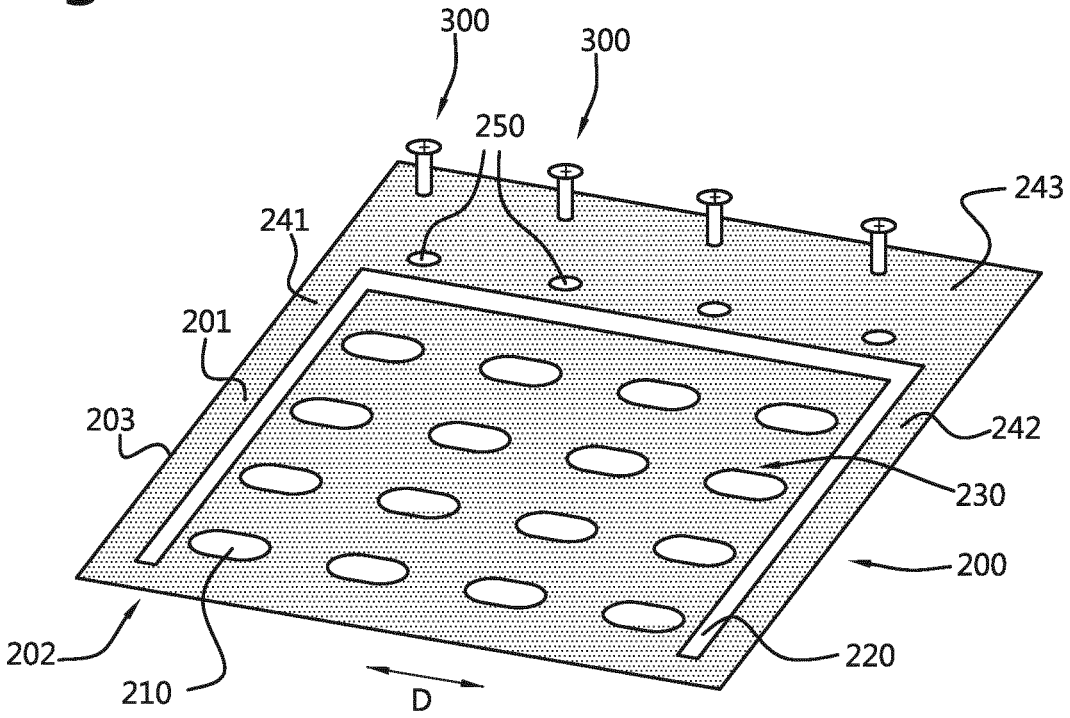
FIG. 7 illustrates a schematic perspective view of an exemplary embodiment of a luminaire system with a second support which is movable in one direction parallel to the first support.
Figure 7:
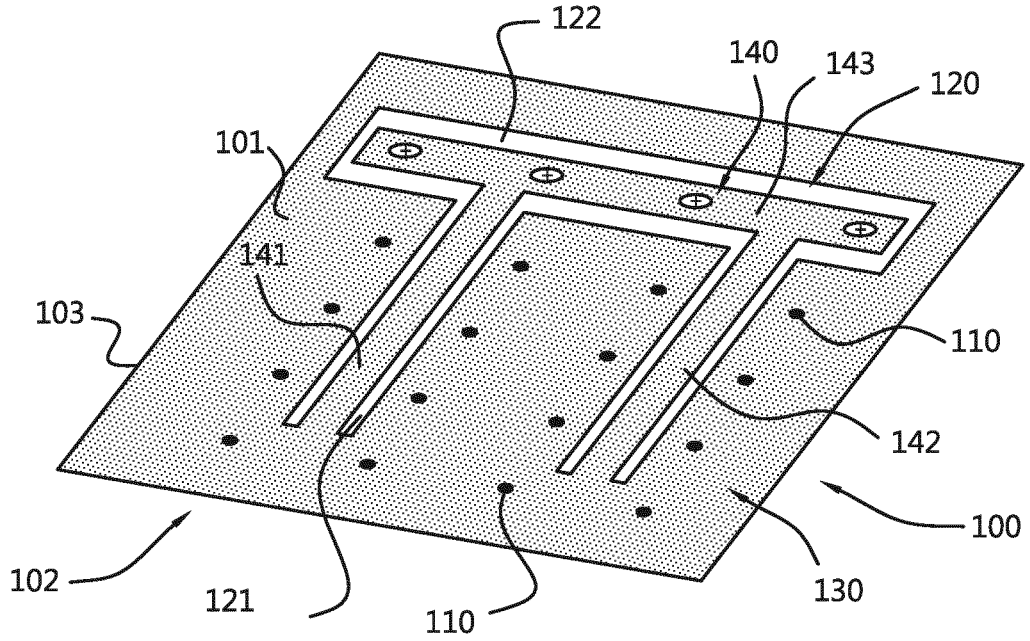

FIG. 1 illustrates a first exemplary embodiment of a first support for use in a luminaire system. The first support 100 is provided with two cut-out regions 120. The cut-out regions 120 extend through the entire thickness of the first support 100. This is also illustrated in FIG. 7, where it can be seen that the first support 100 comprises a first surface 101 on which a plurality of light sources 110 is arranged, a second surface 102 opposite the first surface 101, and a peripheral edge 103. The cut-out region 120 extends through the first surface 101 and the second surface 102. The cut-out regions 120 divide the first support 100 in a first part 130 and a second part 140. The cut-out regions 120 comprise a first cut-out region 121 and a second cut-out region 122. The cut-out regions 121, 122 are dimensioned and positioned such that the second part 140 can be elastically bend with respect to the first part 130 at least in a plane of the first support 100. The second part 140 is coupled to the second support (not shown) e.g. using fixation means 300 such as screws extending through the second support into the second part 140 of the first support 100.

In the embodiment of FIG. 1, the second part 140 of the first support 100 comprises a first leg 141, a second leg 142 and a connecting part 143 connecting the first leg 141 with the second leg 142. Preferably, the connecting part 143 is coupled to the second support (not shown) e.g. using fixation means 300. In such an embodiment, the elastic bending of the second part will mainly occur in the first and second leg 141, 142. The first leg 141, the second leg 142 and the connecting part 143 form a substantially π-shaped second part 140. The first cut-out region 121 is provided along an inner edge of the π-shaped second part 140, and the second cut-out region 122 is provided along an outer edge of the π-shaped second part 140. Such first and second cut-out regions 121, 122 allow the first and second leg 141, 142 to be bent and moved with respect to the first part 130 of the first support 100. Such a π-shaped second part 140 is well-suited for allowing the second support to be moved in a controlled manner with respect to the first part 130 of the first support 100.

The plurality of light sources 110 are arranged on the first support 100 along a plurality of tracks T1, T2, T3. In the illustrated embodiment, it is shown that at least one track thereof, here tracks T2 and T3, is located between the first leg 141 and the second leg 142 of the second part 140. By using a π-shaped second part 140, one or more tracks T2, T3 for connecting the light sources 110 can be located in between the first and the second leg 141, 142 resulting in a compact structure. Preferably the tracks T1, T2, T3 are not provided on the first and second leg 141, 142 as these legs will be elastically deformed. The first and second legs 141, 142 may have a width wt between 0.5 and 5 mm, more preferably between 0.5 and 2 mm. The first and second cut-out region 121, 122 may have a width wc between 1 and 5 mm Preferably, the value for wc is chosen such that if the first or second leg is bent over a distance wc, the yield point is not yet reached. The tracks T1, T2 for connecting the light sources 110 may be at a distance dt of the cut-out region, said distance dt being larger than 2 mm, preferably larger than 3 mm Typically the distance dt may be between 1.5 and 4 mm. As shown in FIG. 1, the cut-out parts 120 may have rounded edges 125 in the corners in order to avoid high stresses during bending.

Figure 2:
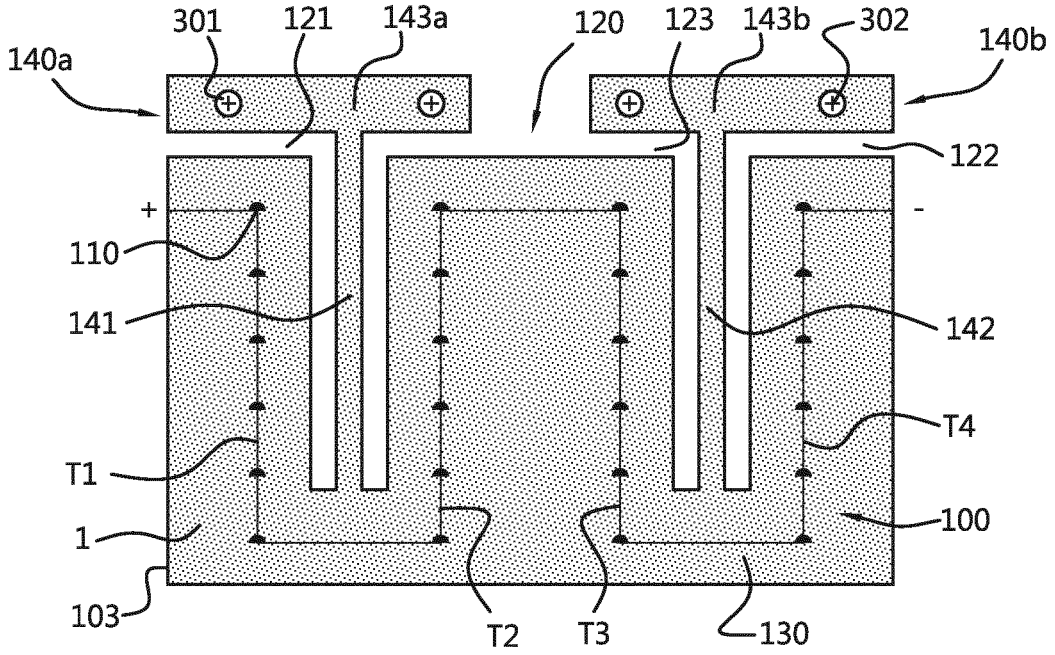
FIG. 2 illustrates a schematic top view of another exemplary embodiment of a first support for use in a luminaire system.

FIG. 2 illustrates another exemplary embodiment of a first support 100 for use in a luminaire system. The first support 100 has a first surface 101 on which a plurality of light sources 110 are arranged in a similar way as described above for the embodiment of FIG. 1. The first support 100 has a second surface (not visible) opposite the first surface 101, and a peripheral edge 103 connecting the first surface 101 to the second surface. The first support 100 is provided with at least one cut-out region 120, here a first cut-out region 121, a second cut-out region 122, and a third cut-out par 123. The cut-out regions 121, 122, 123 divide the first support 100 in a first part 130, and two second parts 140*a*, 140*b*. The cut-out regions 121, 122, 123 are dimensioned and positioned such that the second parts 140*a*, 140*b* can be elastically bent with respect to the first part 130 at least in a plane of the first support 100. The second part 140*a* is coupled to the second support (not shown) e.g. using fixation means 301 such as screws. Similarly, the second part 140*b* is coupled to the second support (not shown) e.g. using fixation means 302. The second parts 140*a*, 140*b* may be e.g. T-shaped or F-shaped part with a bendable leg 141, 142 and a connecting part 143*a*, 143*b*. The fixation means 301, 302 are preferably provided at the connecting parts 143*a*, 143*b*. In a similar manner as described in connection with FIG. 1, the light sources 110 may be arranged along a plurality of tracks T1, T2, T3, T4 and at least one of those tracks T2, T3 may be arranged between the legs 141, 142 of the second parts 140*a*, 140*b*.

Figure 3:
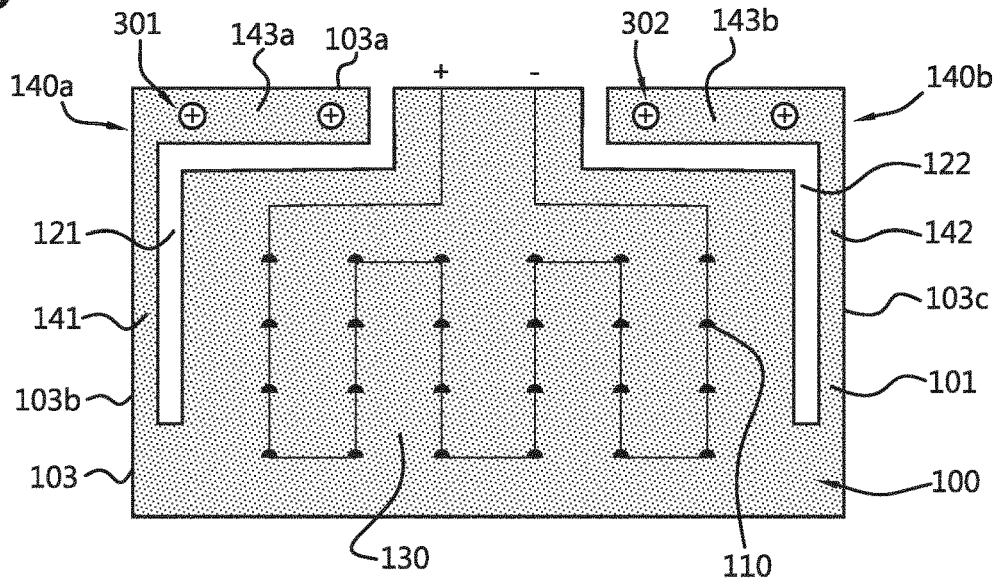
FIG. 3 illustrates a schematic top view of yet another exemplary embodiment of a first support for use in a luminaire system.

FIG. 3 illustrates yet another exemplary embodiment of a first support 100 for use in a luminaire system. The first support 100 has a first surface 101 on which a plurality of light sources 110 are arranged in a similar way as described above for the embodiments of FIGS. 1 and 2. The first support 100 has a second surface (not visible) opposite the first surface 101, and a peripheral edge 103 connecting the first surface 101 to the second surface. The first support 100 is provided with at least one cut-out region 120, here a first cut-out region 121 and a second cut-out region 122. The cut-out regions 121, 122 divide the first support 100 in a first part 130, and two second parts 140*a*, 140*b*. The cut-out regions 121, 122 are dimensioned and positioned such that the second parts 140*a*, 140*b* can be elastically bent with respect to the first part 130 at least in a plane of the first support 100. The cut-out region 121 extends from a first side 103*a* of the first support 100 inwardly, and has a portion which is parallel to a second side 103*b* of the first support 100. Similarly, the cut-out region 122 extends from the first side 103*a* of the first support 100 inwardly, and has a portion which is parallel to a third side 103*c* of the first support 100. The second part 140*a* is coupled to the second support (not shown) e.g. using fixation means 301 such as screws. Similarly, the second part 140*b* is coupled to the second support (not shown) e.g. using fixation means 302. The second parts 140*a*, 140*b* may be e.g. F-shaped parts arranged in two corners of the first support and each having a bendable leg 141, 142 and a connecting part 143*a*, 143*b*. The fixation means 301, 302 are preferably provided at the connecting parts 143*a*, 143*b*. In a similar manner as described in connection with FIG. 1, the light sources 110 may be arranged along a plurality of tracks T1, T2, T3, T4 and at least one of those tracks, here all the tracks T1, T2, T3, T4 may be arranged between the legs 141, 142 of the second parts 140*a*, 140*b*.

In yet other non-illustrated examples, the first support may be provided with only one second part, e.g. a Γ-shaped part such as part 140*a* or 140*b* of FIG. 2 or 3. In such an embodiment, the second support could also be rotated relative to the first part of the first support, wherein the elastic bending of the second part, and in particular of a leg thereof, will control and guide the movement of the second support.

Figure 4A:
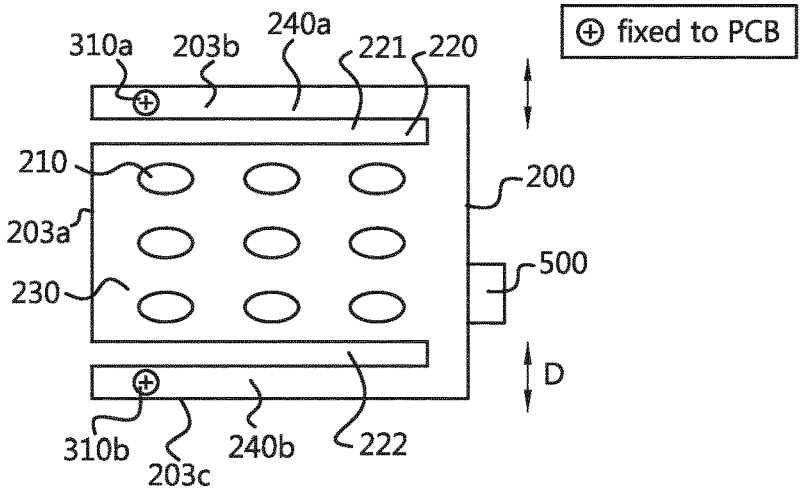
FIGS. 4A and 4B illustrate schematic top views of two exemplary embodiments of a second support for use in a luminaire system.
Figure 4B:
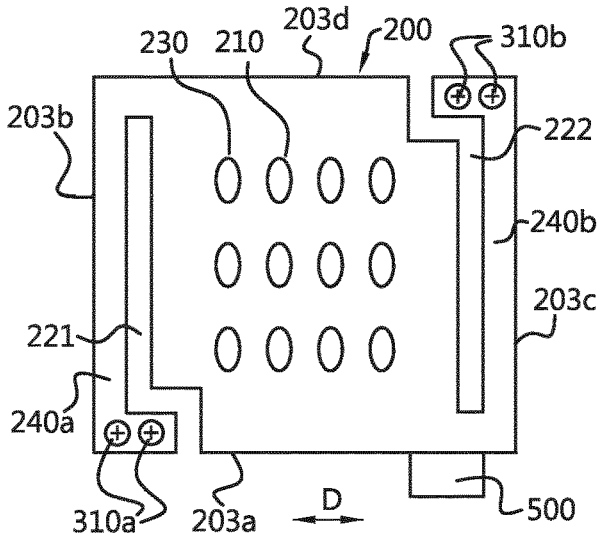

FIGS. 4A and 4B illustrate two exemplary embodiments of a second support 200 for use in a luminaire system. The second support 200 has a first surface 201, a second surface (not visible) opposite the first surface 201, and a peripheral edge 203 connecting the first surface 201 to the second surface. The second support 200 is provided with a plurality of optical elements 210, e.g. lens elements. More in particular the second support 200 may be a lens plate with integrated lens elements 210. The second surface (not visible) is meant to be facing the first surface of the first support, see also FIG. 8. Typically the optical elements 210 will protrude outwardly from the first surface 201 of the second support 200. The second support 200 is provided with at least one cut-out region 220, here a first cut-out region 221 and a second cut-out region 222. The cut-out regions 221, 222 divide the second support 200 in a first part 230, and two second parts 240*a*, 240*b*. The cut-out regions 221, 222 are dimensioned and positioned such that the second parts 240*a*, 240*b* can be elastically bent with respect to the first part 230 at least in a plane of the second support 200. In FIGS. 4A and 4B, the cut-out region 221 extends from a first side 203*a* of the second support 200 inwardly, and has a portion which is parallel to a second side 203*b* of the second support 200. In FIG. 4A, the cut-out region 222 extends from a first side 203*a* of the second support 200 inwardly, and has a portion which is parallel to a third side 203*c* of the second support 200. In FIG. 4A, the cut-out region 222 extends from a fourth side 203*d* of the second support 200 inwardly, and has a portion which is parallel to a third side 203*c* of the second support 200. The second part 240*a* is coupled to the first support (not shown) e.g. using fixation means 310*a* such as screws. Similarly, the second part 240*b* is coupled to the first support (not shown) e.g. using fixation means 310*b*. The second parts 240*a*, 240*b* may be arranged at opposite outer edges of the second support 200, and may each have a rectangular shape to form a bendable leg. The fixation means 310*a*, 310*b* are preferably provided at a free outer end of such a bendable leg 240*a*, 240*b*. As shown in FIG. 4B, to obtain a good coupling and to avoid that the second support can be rotated around the fixation means 310*a*, 310*b*, there may be provided two fixation means for each second part 240*a*, 240*b* positioned at a distance of each other, see in a direction parallel to the moving direction D. In order to make this possible the second parts 240*a*, 240*b* may be F-shaped or T-shaped with one end connected to the first part 230 and the other end being a free end coupled to the first support.

A moving means 500 is configured to move the second support 200 with respect to a first support (not shown) in a direction D which is preferably oriented substantially perpendicularly on a length direction of the second parts 240*a*, 240*b*, such that the second parts 240*a*, 240*b* are bent when the first part 230 is moved in the direction D.

Figure 5A:
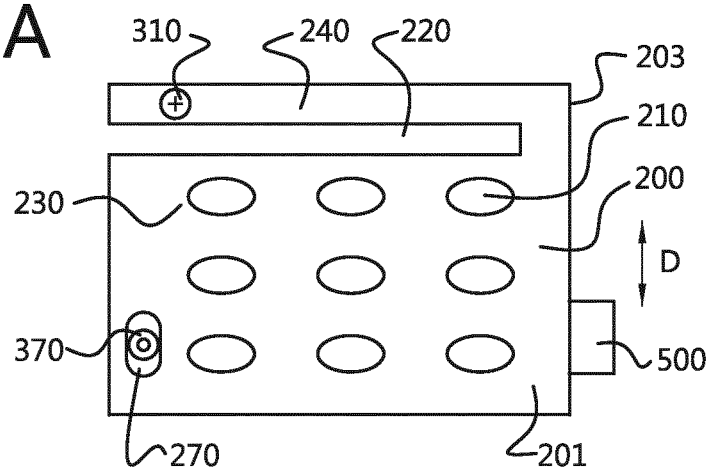
FIGS. 5A and 5B illustrate schematic top views of two other exemplary embodiments of a second support for use in a luminaire system.
Figure 5B:
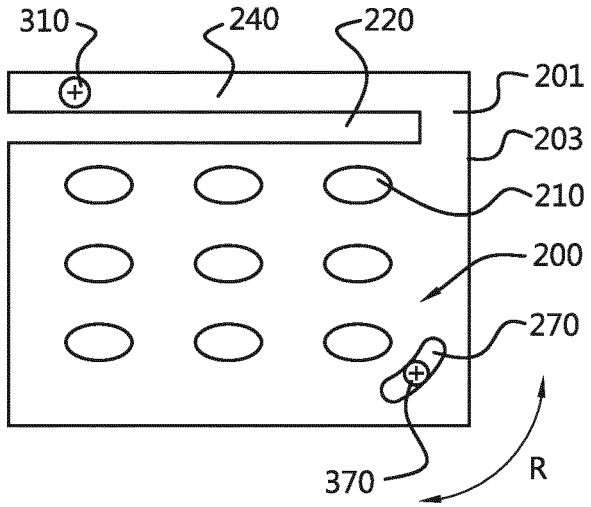

FIGS. 5A and 5B illustrate two other exemplary embodiments of a second support 200 for use in a luminaire system. The second support 200 has a first surface 201, a second surface (not visible) opposite the first surface 201, and a peripheral edge 203 connecting the first surface 201 to the second surface. The second support 200 is provided with a plurality of optical elements 210, e.g. lens elements. More in particular the second support 200 may be a lens plate with integrated lens elements 210, in a similar way as described above for FIG. 3. The second support 200 is provided with a cut-out region 220. The cut-out region 220 divides the second support 200 in a first part 230 and a second part 240. The cut-out region 220 are dimensioned and positioned such that the second part 240 can be elastically bent with respect to the first part 230 at least in a plane of the second support 200. The second part 240 is coupled to the first support (not shown) e.g. using fixation means 310 such as a screw. The second part 240 may be arranged at an outer edge of the second support 200, and may have a substantially rectangular shape to form a bendable leg. The cut-out region 220 may then be oriented substantially parallel to the bendable leg, such that the leg can move inwardly in the direction of the first part 230 of the second support 200. The fixation means 310 is preferably provided at a free outer end of such a bendable leg 240.

In FIG. 5A, a moving means 500 is configured to move the second support 200 with respect to a first support (not shown) in a direction D which is preferably oriented substantially perpendicularly on a length direction of the second part 240, such that the second parts 240 is bent when the first part 230 is moved in the direction D. Further, there may be provided a guiding means configured to guide the movement of the second support 200. The guiding means may comprise an elongated hole 270 in the second support 200, and a rod 370 arranged in said hole 270, e.g. a bolt fixed in the first support. In FIG. 5A, the elongate hole 270 is a rectilinear hole and the second support 200 is movable in a direction D parallel to a length direction of the elongate hole 270. In FIG. 5B, the elongated hole 270 extends in a circular direction. For the embodiment of FIG. 5B, the second support 200 may be rotated in a direction R around an axis of the fixation means 310.

Figure 6:
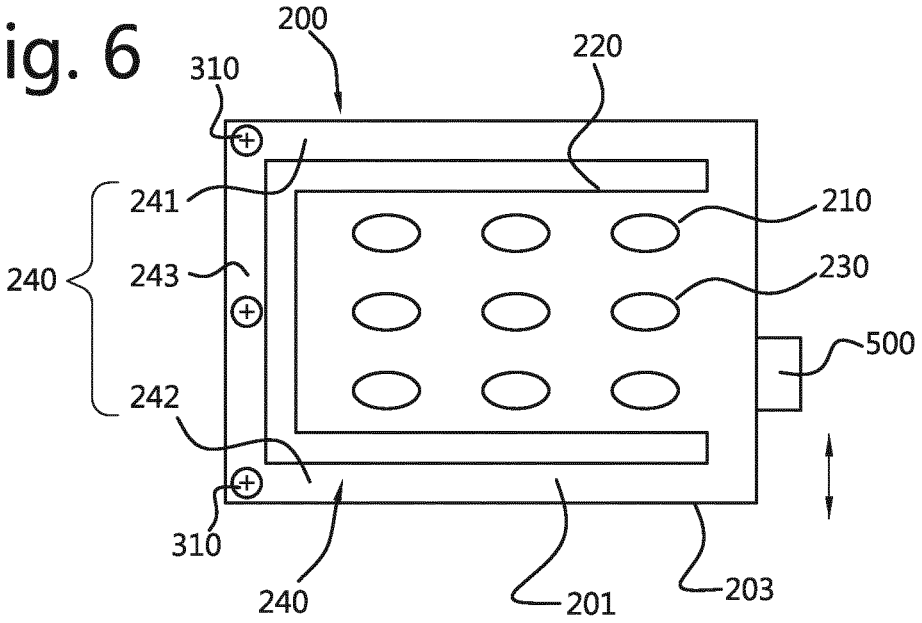
FIG. 6 illustrates a schematic top view of yet another exemplary embodiment of a second support for use in a luminaire system.

FIG. 6 illustrates yet another exemplary embodiment of a second support 200 for use in a luminaire system. The second support 200 has a first surface 201, a second surface (not visible) opposite the first surface 201, and a peripheral edge 203 connecting the first surface 201 to the second surface. The second support 200 is provided with a plurality of optical elements 210, e.g. lens elements. More in particular the second support 200 may be a lens plate with integrated lens elements 210 protruding outwardly of the lens plate. The second support 200 is provided with a cut-out region 220. The cut-out region 220 divides the second support 200 in a first part 230, and a second part 240. The cut-out region 220 is dimensioned and positioned such that the second part 240 can be elastically bent with respect to the first part 230 at least in a plane of the second support 200. The second part 240 is coupled to the first support (not shown) e.g. using fixation means 310 such as screws.

The second part 240 of the second support 200 is located along three outer edges of the second support 200 and comprises a first leg 241 extending along a first outer edge, a second leg 242 extending along a second outer edge, and a connecting part 243 connecting the first leg 241 with the second leg 242 and extending along a third outer edge. Preferably, the connecting part 243 is coupled to the first support (not shown) e.g. using fixation means 310. In such an embodiment, the elastic bending of the second part will mainly occur in the first and second leg 241, 242. The first leg 241, the second leg 242 and the connecting part 243 form a substantially π-shaped second part 240. The cut-out region 220 is provided along an inner edge of the π-shaped second part 240. Such a cut-out region 220 allows the first and second leg 241, 242 to be bent and the first part 230 to be moved with respect to the first support (not shown). Such a π-shaped second part 240 is well-suited for allowing the first part 230 of the second support 200 to be moved in a controlled manner with respect to the first support. A moving means 500 is configured to move the first part 230 of the second support 200 with respect to a first support (not shown) in a direction D which is preferably oriented substantially parallel to the connecting part 243 extending along the third outer edge, such that the legs 141, 142 are bent when the first part 230 is moved in the direction D.

The examples provided in FIGS. 1, 2 and 3 for the first support may be combined with a standard second support, e.g. a standard lens plate with integrated lens elements, or a frame provided with optical elements, or a frame provided with a plurality of lens plates. Also, the examples provided in FIGS. 4, 5A, 5B and 6 for the second support may be combined with a standard first support, e.g. a PCB provided with a plurality of light sources, wherein each light sources may comprises one or more LEDs. Further, it is possible to combine a first support of any one of the FIGS. 1, 2 and 3 with a second support of any one of the FIGS. 4, 5A, 5B and 6. This may be done to increase the possible movement directions and/or the degree of movement, as will be illustrated below in connection with FIGS. 7 and 8.

FIG. 7 illustrates an exemplary embodiment of a luminaire system comprising a first support 100 and a second support 200. The first support 100 is similar to the support 100 of the FIG. 1. In order to allow for an additional amount of movement of the second support 200 in a movement direction D, also the second support 200 is provided with a cut-out region 220. The second support 200 is similar to the second support 200 of FIG. 6. The cut-out region divides the second support 200 into a first part 230 and a second part 240 comprising a first leg 241 extending along a first outer edge, a second leg 242 extending along a second outer edge, and a connecting part 243 connecting the first leg 241 with the second leg 242, and extending along a third outer edge. The peripheral edge 203 of the second support 200 is formed by the first, second and third outer edge form together with a fourth outer edge opposite the third outer edge. Preferably, the connecting part 243 of the second support 200 is coupled to the connecting part 143 of the first support 100 e.g. using a plurality of fixation means 300, e.g. a plurality of screws or bolts. In that manner, when the first part 230 of the second support 200 is moved in a direction D, both legs 241, 242 of the second support 200 as well as legs 141, 142 of the first support may be elastically bent, increasing the range over which the first part 230 may be moved.

Figure 8:
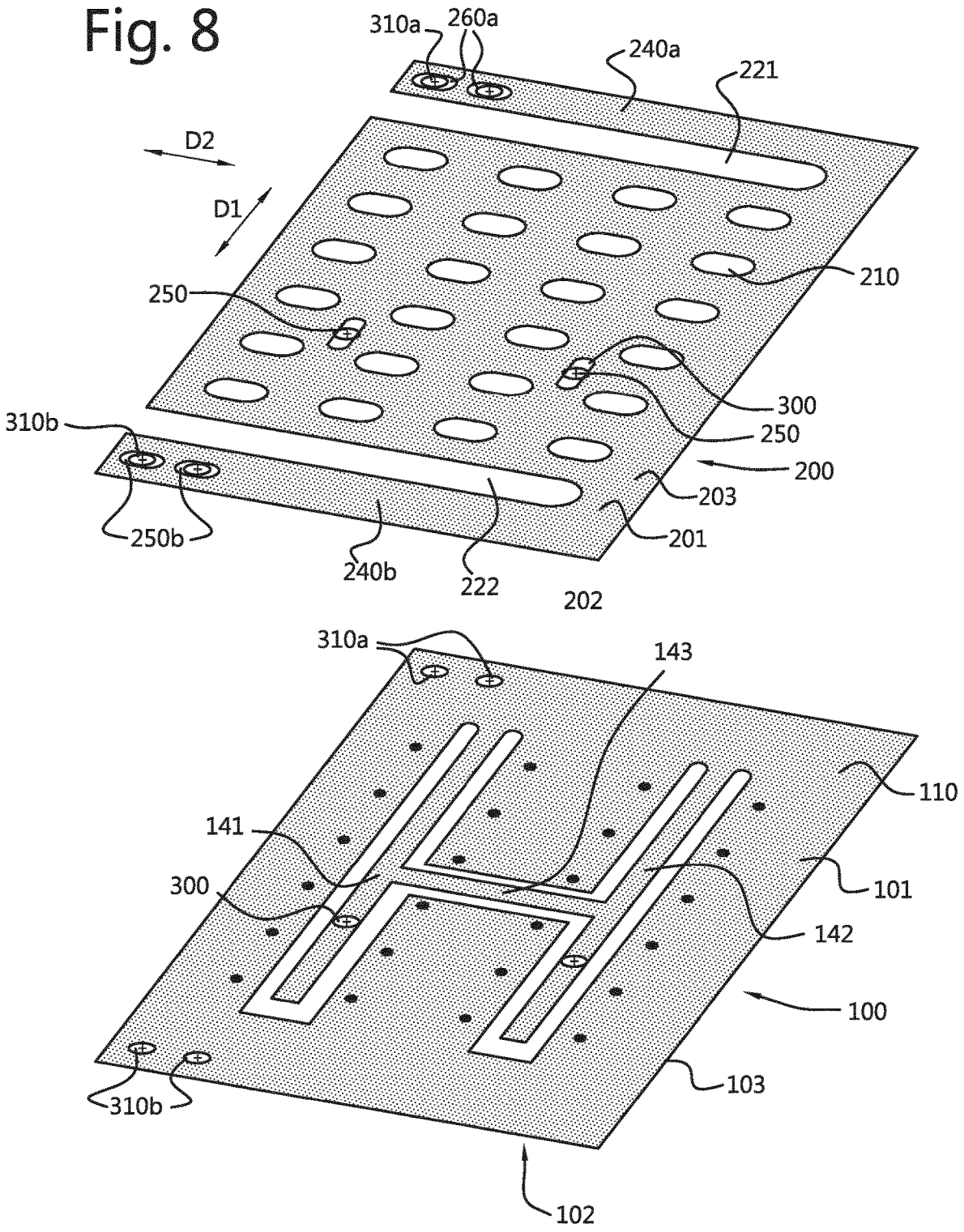
FIG. 8 illustrates a schematic perspective view of an exemplary embodiment of a luminaire system with a second support which is movable in two directions parallel to the first support.

FIG. 8 illustrates an exemplary embodiment of a luminaire system comprising a first support 100 and a second support 200. The first support 100 is similar to the support 100 of the FIG. 1 with this difference that the second part 400 is substantially H-shaped with a first leg 141, a second leg 142 and a connecting part 143 connecting a central portion of the first leg 141 with a central portion of the second leg 142. The second support 200 is similar to the second support 200 of FIG. 4 with two cut-out regions 221, 222 creating two second parts 240*a*, 240*b* provided along opposite outer edges of the second support 200. The cut-out regions 221, 222 divide the second support 200 into a first part 230 and the two second parts 240*a*, 240*b* forming two bendable legs. Preferably, the connecting part 143 of the first support 100 is coupled to a central portion of the second support 200, e.g. using a plurality of fixation means 300, e.g. a plurality of screws or bolts. Similarly the free outer ends of the flexible legs 240*a*, 240*b* may be coupled to a peripheral area of the first support 100 e.g. using a plurality of fixation means 310*a*, 310*b*, e.g. a plurality of screws or bolts. Preferably, the legs 240*a*, 240*b* of the second support 200 extend substantially perpendicularly on the legs 141, 142 of the first support 100, in order to allow for a movement in two directions D1, D2.

Further, in order to allow for a movement in two directions D1, D2, the fixation means 300, 310*a*, 310*b* may extend through elongate holes 250, 260*a*, 260*b*. For example, the first direction D1 may be substantially perpendicular to the legs 240*a*, 240*b*, and the elongate holes 250 in the second support 200 may extend substantially parallel to the first direction D1. For example, the second direction D2 may be substantially perpendicular to the legs 141, 141 of the first support 100, and the elongate holes 260*a*, 260*b* in the second support 200 may extend substantially parallel to the second direction D2. In that manner, the first part 230 of the second support 200 may be moved independently in the direction D1 and D2, wherein the both legs 240*a*, 240*b* of the second support 200 as well as legs 141, 142 of the first support 100 may be elastically bent, such that a well-controlled movement in two directions D1, D2 is achieved.

Figure 9:
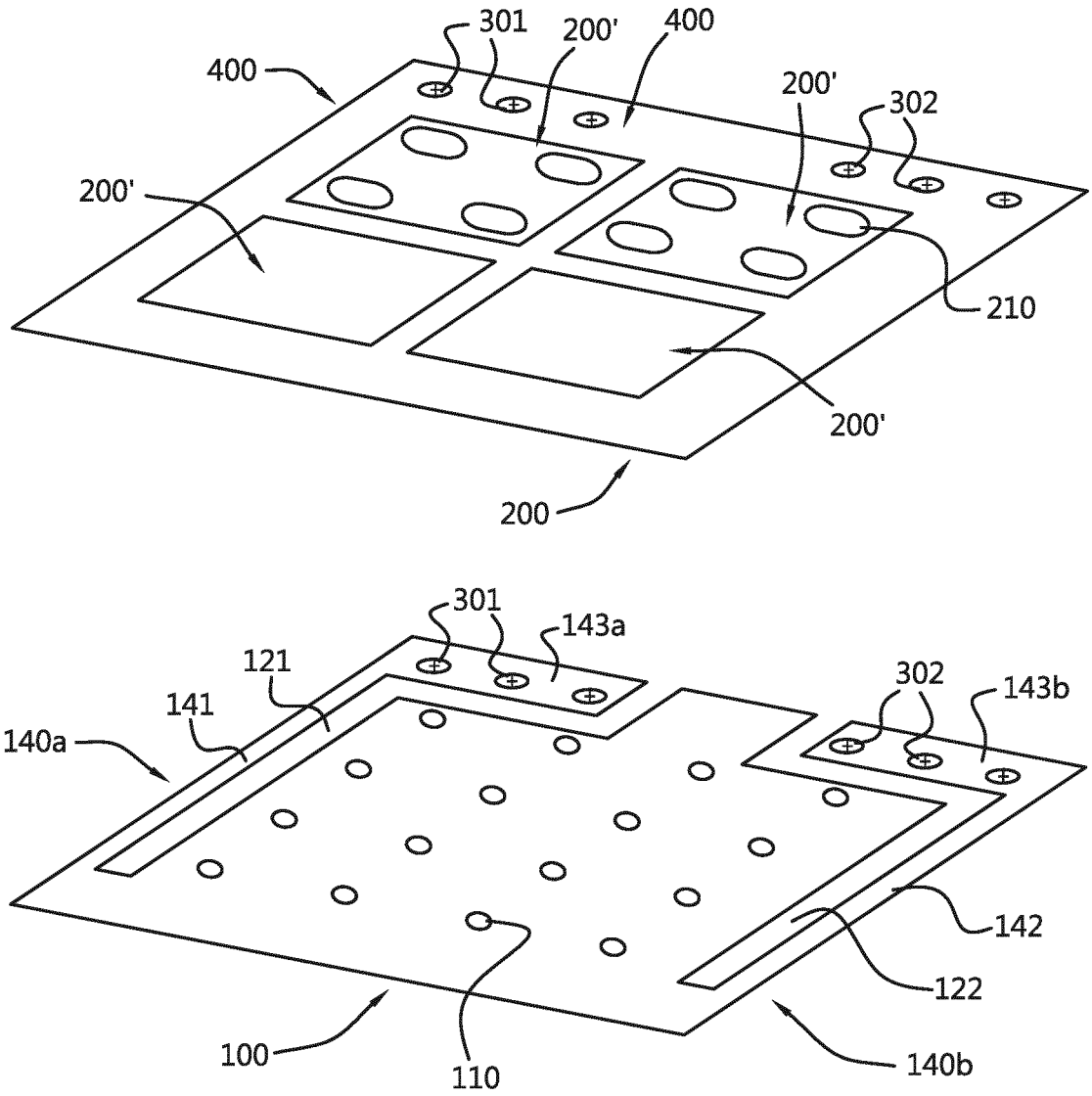
FIG. 9 illustrates a schematic perspective view of an exemplary embodiment of a luminaire system with a plurality of second supports provided in a frame, wherein the frame is movable in one direction parallel to the first support.

FIG. 9 illustrates another exemplary embodiment of a luminaire system comprising a first support 100 and a second support 200 comprising a plurality of lens plates 200' arranged in a frame 400. The first support 100 is similar to the support 100 of the FIG. 3 and reference is made to the description given above. Preferably, the connecting parts 143*a*, 143*b* of the first support 100 are coupled to an edge portion of the frame 400 of the second support 200, e.g. using a plurality of fixation means 301, 302, e.g. a plurality of screws or bolts.

FIGS. 10A-10E illustrate in more detail another embodiment of a "double bulged" lens element suitable for use in embodiments of the invention. The lens element 210 of FIGS. 10A-10E has an internal surface 210*i* facing a light source 110 and an external surface 210*e*. The internal surface 210*i* comprises a first curved surface 211*b* in the form of a first outwardly bulging surface and a second curved surface 212*b* in the form of a second outwardly bulging surface. The first curved surface 211*b* is connected to the second curved surface 212*b* through an internal connecting surface or line 213*b* comprising a saddle point or discontinuity. The external surface 210*e* comprises a first curved surface 211*a* in the form of a first outwardly bulging surface and a second curved surface 212 in the form of a second outwardly bulging surface. The first curved surface 211*a* is connected to the second curved surface 212*a* through an external connecting surface or line 213*a* comprising a saddle point or discontinuity. The second support 200 is movable relative to said first support 100 such that the light source 110 can be in at least a first position P1 facing the first curved surfaces 211*a*, 211*b* or in at least a second position P2 facing the second curved surfaces 212*a*, 212*b*. The lens element 210 has a circumferential edge 218 in contact with the first support 100, and the internal connecting surface or line 213*b* is at a distance of the first support 100. In other words the lens element 210 moves in contact with the first support 100, and the distance between the internal connecting surface or line 213*b* and the first support allows the light source to pass underneath the connecting surface or line 213*b* when the second support 200 is moved from a first position where the light source 110 faces the first curved surfaces 211*a*, 211*b* to a second position where the light source 110 faces the second curved surfaces 212*a*, 212*b*. As is best visible in FIG. 10B, the external connecting surface 213*a* comprises a "line" portion in a central part, and two "surface" portions on either side of the "line" portion. Optionally, the external connecting surface 213*b* may be covered partially with a reflective coating, e.g. the hatched "surface" portions in the top view of FIG. 10B may be provided with a reflective coating.

Figure 10A:
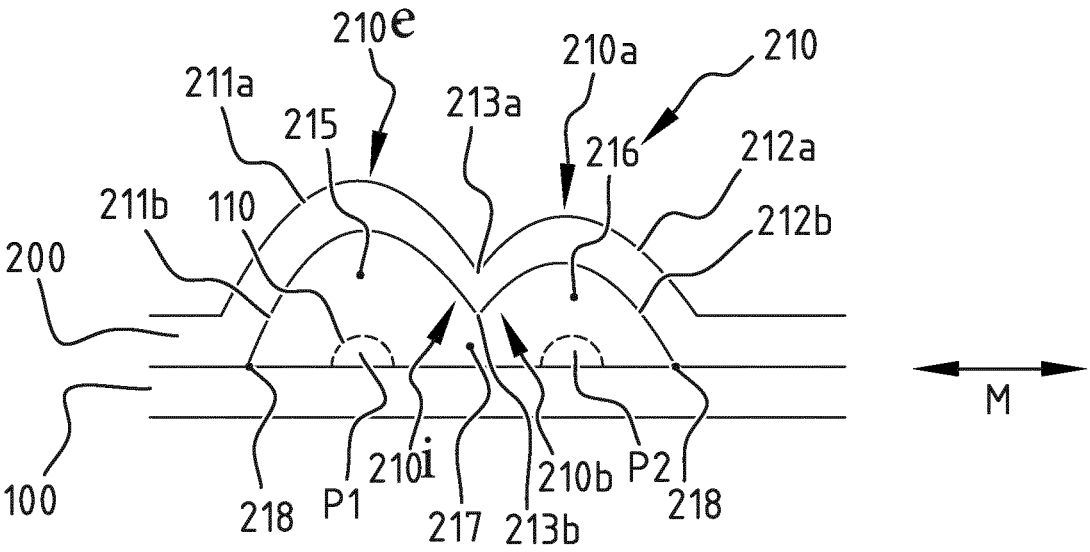
FIG. 10A shows a schematic cross-sectional view of another exemplary embodiment of a lens element.
Figure 10B:
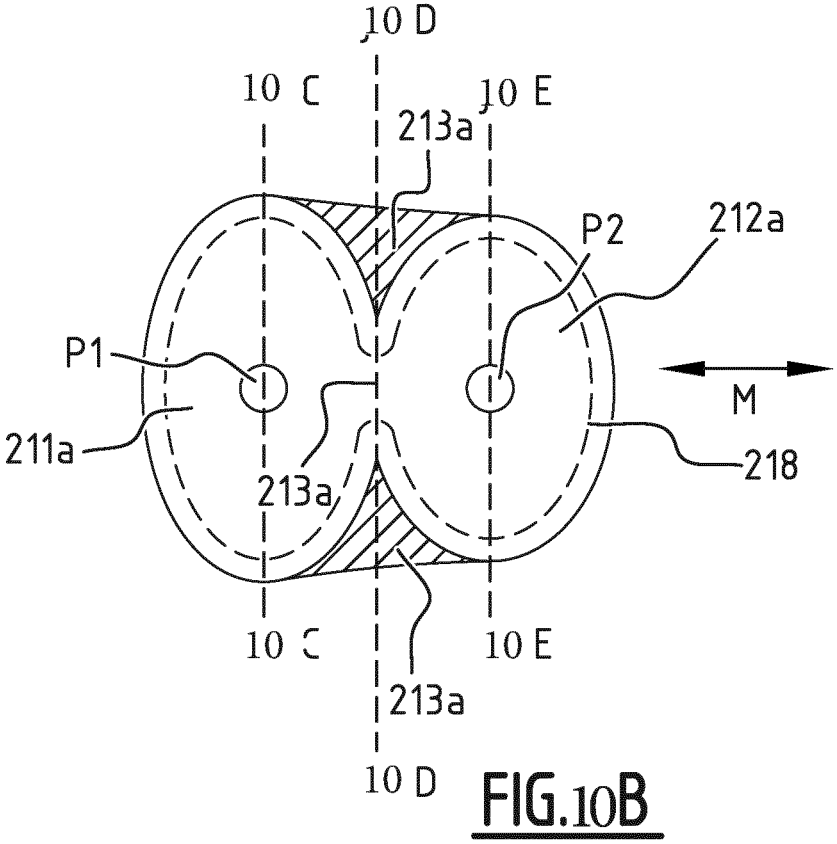
FIG. 10B shows a schematic top view of the lens element of FIG. 10A.
Figure 10C:
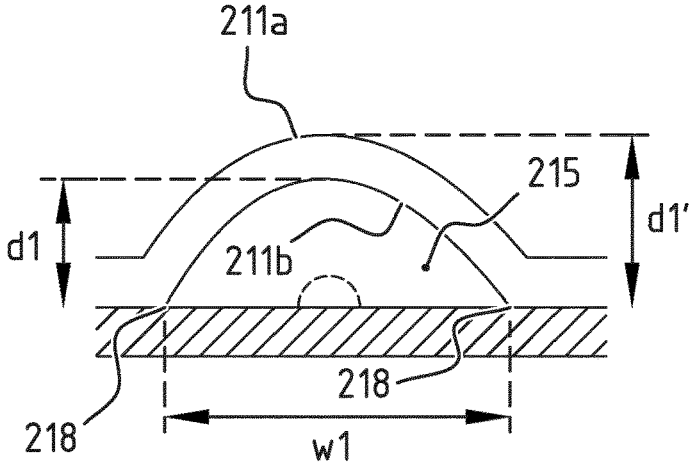
FIGS. 10C, 10D, 10E are schematic cross-sectional views of the lens element along lines 10C-10C, 10D-10D, 10E-10E shown in FIG. 10B.
Figure 10D:
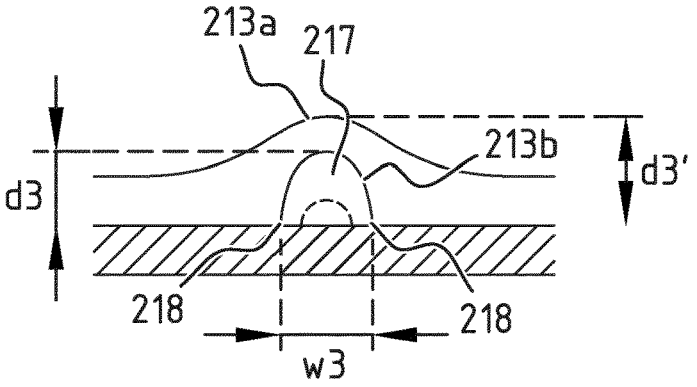
Figure 10E:
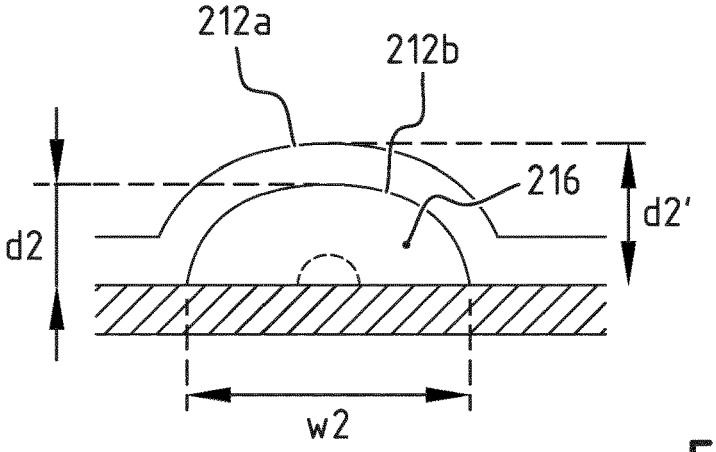

The first outwardly bulging surface 211*b* and the first support 100 delimit a first internal cavity 215, the second outwardly bulging surface 212*b* and the first support 100 delimit a second internal cavity 216, and the internal connecting surface or line 213*b* and the first support 100 delimit a connecting passage 217 between the first and second internal cavity. FIG. 10C shows a cross section along line 10C-10C in FIG. 10B, and illustrates that the first internal cavity 215 has a first maximal width w1, said first maximal width extending in a direction perpendicular on the moving direction M and measured in an upper plane of the first support 100. Similarly, FIG. 10D shows a cross section along line 10D-10D in FIG. 10B, and illustrates that the second internal cavity 216 has a second maximal width w2. FIG. 10E shows a cross section along line 10E-10E in FIG. 10B, and illustrates that the connecting passage 217 has a third minimal width w3. The first maximal width w1 and the second maximal width w2 are preferably larger than the third width w3. Also, the first maximal width w1 and the second maximal width w2 may be different. The first outwardly bulging surface 211*b* is at a first maximal distance d1 of the first support 100, the second outwardly bulging surface 212*b* is at a second maximal distance d2 of the first support 100, and the internal saddle point or discontinuity is at a third minimal distance d3 of the first support 100. The third minimal distance d3 may be lower than said first and second maximal distance d1, d2. Preferably, the first and second maximal distance d1, d2 are different. Similarly, the first outwardly bulging surface 211*a* is at a first maximal distance d1' of the first support 100, the second outwardly bulging surface 212*a* is at a second maximal distance d2' of the first support 100, and the external saddle point or discontinuity is at a third minimal distance d3' of the first support 100. The third minimal distance d3' may be lower than the first and second maximal distance d1', d2'. Preferably, the first and second maximal distance d1', d2' are different.

Whilst the principles of the invention have been set out above in connection with specific embodiments, it is to be understood that this description is merely made by way of example and not as a limitation of the scope of protection which is determined by the appended claims.

The invention claimed is:

1. A luminaire system comprising:

a first support having a first surface, a second surface opposite said first surface, and a peripheral edge connecting the first surface to the second surface;

a plurality of light sources arranged on the first support;

a second support movable with respect to said first support and provided with one or more optical elements; said second support having a first surface, a second surface opposite said first surface, and a peripheral edge connecting the first surface to the second surface;

a moving means configured to move the second support relative to the first support, such that a position of the second support with respect to the first support is changed;

wherein the first support is provided with at least one cut-out region extending through the first surface and the second surface of the first support, said at least one cut-out region dividing said first support in a first part and at least one second part, said at least one cut-out region being dimensioned and positioned such that said at least one second part can be elastically bent with respect to the first part in a plane of the first support, wherein said at least one second part is coupled to the second support; and/or wherein the second support is provided with at least one cut-out region extending through the first surface and the second surface of the second support, said at least one cut-out region dividing said second support in a first part and at least one second part, said at least one cut-out region being dimensioned and positioned such that said at least one second part can be elastically bent with respect to the first part in a plane of the second support, wherein said at least one second part is coupled to the first support.

2. The luminaire system according to claim 1, wherein the at least one second part of the first and/or second support comprises a first leg and a second leg.

3. The luminaire system according to claim 2, wherein the at least one second part of the first and/or second support further comprises a connecting part connecting said first leg with said second.

4. The luminaire system according to claim 2, wherein the plurality of light sources are arranged along a plurality of tracks, and wherein at least one track thereof is located between said first leg and said second leg of said first support.

5. The luminaire system according to claim 1, wherein said at least one second part of the first and/or second support comprises a substantially π-shaped second part.

6. The luminaire system according to claim 5, wherein said at least one cut-out region comprises a first cut-out region along an inner edge of said π-shaped second part and a second cut-out region along an outer edge of said π-shaped second part; or wherein said at least one cut-out region of the first and/or second support comprises a cut-out region along an inner edge of said π-shaped second part, and wherein an outer edge of the π-shaped second part corresponds with a portion of the peripheral edge of the first support and/or second support, respectively.

7. The luminaire system according to claim 1, wherein the first and/or second support is a polygon having a first side and an adjacent second side, wherein said at least one cut-out region of the first and/or second support extends inwardly from the first side, and has a portion which is substantially parallel to a second side of the peripheral edge such that a second part is formed which extends along the second side.

8. The luminaire system according to claim 1, wherein the second support is provided with at least one through-hole, and wherein at least one fixation means, such as a screw or bolt, extends through said at least one through-hole and couples the second support to the at least one second part of the first support.

9. The luminaire system according to claim 1, wherein the at least one second part of the second support is provided with at least one through-hole, and wherein at least one fixation means, such as a screw or bolt, extends through said at least one through-hole and couples the second support to the first part of the first support.

10. The luminaire system according to claim 1, wherein the second support comprises a frame and a one or more elements arranged in the frame, and wherein the at least one second part of the first support is fixed to the frame.

11. The luminaire system according to claim 1, wherein the first support is mounted substantially parallel to the second support; and wherein the moving means is configured to move the second support substantially parallel to the first support.

12. The luminaire system according to claim 1, wherein the one or more optical elements comprises one or more lens elements.

13. The luminaire system according to claim 1, wherein an optical element of the one or more optical elements has an internal surface facing a light source of the plurality of light sources and an external surface; wherein at least one of said internal surface and said external surface comprises a first curved surface and a second curved surface, said first curved surface being connected to said second curved surface through a connecting surface or line comprising a saddle point or discontinuity; and wherein said second support is movable relative to said first support to position the light source from a first position facing the first curved surface to a second position facing the second curved surface.

14. The luminaire system according to claim 1, wherein the second support is arranged to move in contact with the first support; or wherein the second support is arranged to move at a fixed distance of the first support.

15. The luminaire system according to claim 1, further comprising: a driver configured to drive the plurality of light sources, and optionally a dimmer configured to control the driver to drive one or more of the plurality of light sources at a dimmed intensity.

16. The luminaire system according to claim 1, further comprising a controlling means configured to control the moving means, such that the movement of the second support with respect to the first support is controlled.

17. The luminaire system according to claim 16, wherein the controlling means is configured to control the moving means to position the one or more optical elements in a plurality of positions relative to the plurality of light sources resulting in a plurality of different lighting patterns on a surface.

18. The luminaire system according to claim 16, further comprising a sensing means configured to acquire a measure for a position of the second support relative to the first support; wherein the controlling means is configured to control the moving means in function of the acquired measure.

19. The luminaire system according to claim 16, further comprising an environment sensing means configured to detect environmental data; wherein the controlling means is configured to control the moving means in function of the detected environmental data; and/or further comprising a pattern sensing means configured to acquire a measure for a lighting pattern produced by the luminaire system; wherein the controlling means is configured to control the moving means in function of the acquired measure.

20. The luminaire system according to claim 16, further comprising a transceiver interface, wherein the controlling means is further configured for controlling the moving means based on data received from a remote device through the transceiver interface, and/or wherein the controller is configured to send sensed data through the transceiver interface to a remote device.

* * * * *